US005918681A

United States Patent [19]

Thomas

[11] Patent Number: 5,918,681

[45] Date of Patent: Jul. 6, 1999

[54] FIRE EXTINGUISHING SYSTEM FOR AUTOMOTIVE VEHICLES

[76] Inventor: Orrett H. Thomas, 115-87 230 St., Cambria Heights, N.Y. 11411-1421

[21] Appl. No.: 09/058,375

[22] Filed: Apr. 9, 1998

Related U.S. Application Data

[63] Continuation-in-part of application No. 08/635,747, Apr. 22, 1996, abandoned.

[51] Int. Cl.[6] ..... A62C 3/07

[52] U.S. Cl. ..... 169/62; 169/61

[58] Field of Search ..... 169/26, 28, 61, 169/62

[56] References Cited

U.S. PATENT DOCUMENTS 3,630,288 12/1971 Tiberti et al. ..... 169/61
3,762,479 10/1973 Fike, Sr. et al. ..... 169/28
3,788,666 1/1974 Kramer et al. ..... 280/739
3,986,560 10/1976 Heath et al. ..... 169/61
3,993,138 11/1976 Stevens et al. ..... 169/61

*Primary Examiner*—Andrew C. Pike
*Attorney, Agent, or Firm*—Dilworth & Barrese

[57] ABSTRACT

A fire extinguishing system for vehicles includes a firing assembly for attachment to a container of fire extinguishing agent, a firing pin for penetrating the container to release the fire extinguishing agent, the firing pin being moved by an explosive squib or a solenoid, a conduit for carrying fire extinguishing agent to a discharge outlet, and a control system having a capacitor for pulse discharge of electric power to the control head to fire the squib or solenoid. The control box includes a three-position switch for firing the system, putting the system on automatic function, or deactivating the system. Other switches can include sensors for activating the firing pin in response to high temperature or vehicle impact.

29 Claims, 4 Drawing Sheets

FIRE EXTINGUISHING SYSTEM FOR AUTOMOTIVE VEHICLES

CROSS REFERENCE TO RELATED APPLICATIONS

This application is a continuation-in-part of U.S. application Ser. No. 08/635,747 filed Apr. 22, 1996, now abandoned, to which priority is claimed.

BACKGROUND

1. Field of the Invention

This invention relates to fire extinguishers for vehicles, and particularly to fire extinguishers for automobiles.

2. Background of the Art

Automobile fires cause a great deal of harm and can result in injury or death to the vehicle occupants as well as damage to the vehicle itself. Such fires can result from impact during a collision, or even while the automobile is stationary. It is important for the occupants to have the opportunity to leave the automobile and seek help. Time is of the essence in such circumstances for the vehicle occupants to escape injury, especially since the fuel tank can contain several gallons of volatile and highly flammable gasoline. Accordingly, a device which extinguishes, or even just temporarily suppresses, an automobile fire can make an important contribution to vehicle safety.

What is needed is a fire extinguishing system for vehicles which warns the occupants of a vehicle of a fire and automatically extinguishes or suppresses the fire.

SUMMARY

A fire extinguishing system for a vehicle is provided herein. The fire extinguishing system includes a firing assembly mounted to a container of pressurized fire extinguishing agent, optionally by a threaded screw type engagement. The container has a seal at one end which, when punctured, releases the fire extinguishing agent. In one embodiment of the invention, the firing assembly includes a housing and a piston slidably movable within the interior of the housing between a proximal position and a distal position. The piston has a passageway extending between proximal and distal sides to permit the flow of the fire extinguishing agent therethrough. The firing assembly also includes a firing pin extending from the distal side of the piston, and firing means responsive to an electric current for advancing the piston from the proximal position to the distal position. The firing means can be, for example, an explosive squib or a solenoid.

A control system controlled by at least one control switch delivers the electric current to the firing means, and is supplied by electric current from, for example, a battery and/or a capacitor.

In an alternative embodiment the firing means includes a solenoid for advancing the firing pin in response to an electric pulse.

DETAILED DESCRIPTION OF PREFERRED EMBODIMENTS

The present invention employs a fire extinguishing agent which can be discharged through fire resistant ducts and nozzles into the engine compartment of a vehicle and/or the fuel tank area.

Figure 1:
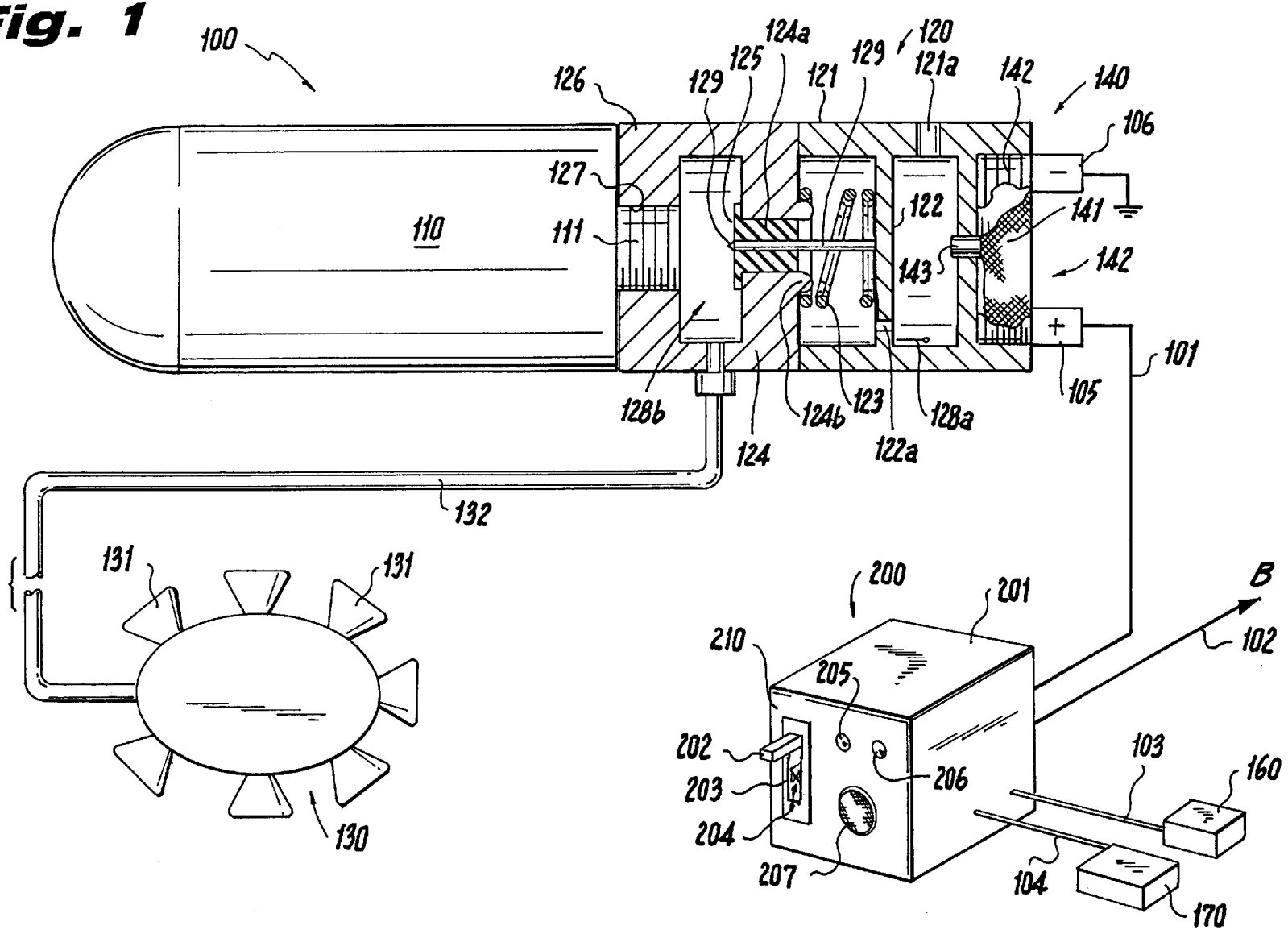
FIG. 1 is a diagrammatic illustration of an embodiment of the invention employing a squib firing system for driving a piston.

Referring now to FIG. 1, an embodiment 100 of the fire extinguishing system is illustrated wherein the fire extinguishing agent, and optionally a propellant, is contained under pressure in cylinder or cartridge 110. The cartridge can be fabricated from, for example, ferrous or nonferrous alloys, aluminum, high strength plastic, or combinations thereof. The fire extinguishing agent can be, for example, a halohydrocarbon such as bromotrichloromethane or bromochlorodifluoromethane, a gas such as nitrogen or carbon dioxide, or other suitable agent for extinguishing or suppressing combustion. Fire agent cartridge 110 includes a proximal sealed outlet portion 111 which is penetrable by a firing pin to release the fire extinguishing agent. The fire agent cartridge 110 is connected to the firing assembly 120 by, for example, screw type mounting as shown, or by a bayonet type mounting.

Firing assembly 120 includes a preferably cylindrical housing 121. A vent aperture 121*a* in the housing wall permits the escape of excess gas from the interior of the housing. Preferably, the firing assembly includes a pressure gauge and/or safety vent to release at least some fire extinguishing agent and/or propellant in the event of excessive buildup of internal pressure. A retainer plate 124 fixedly mounted within the housing 121 divides the interior of the housing into first and second chambers 128*a* and 128*b*, respectively.

Figure 2:
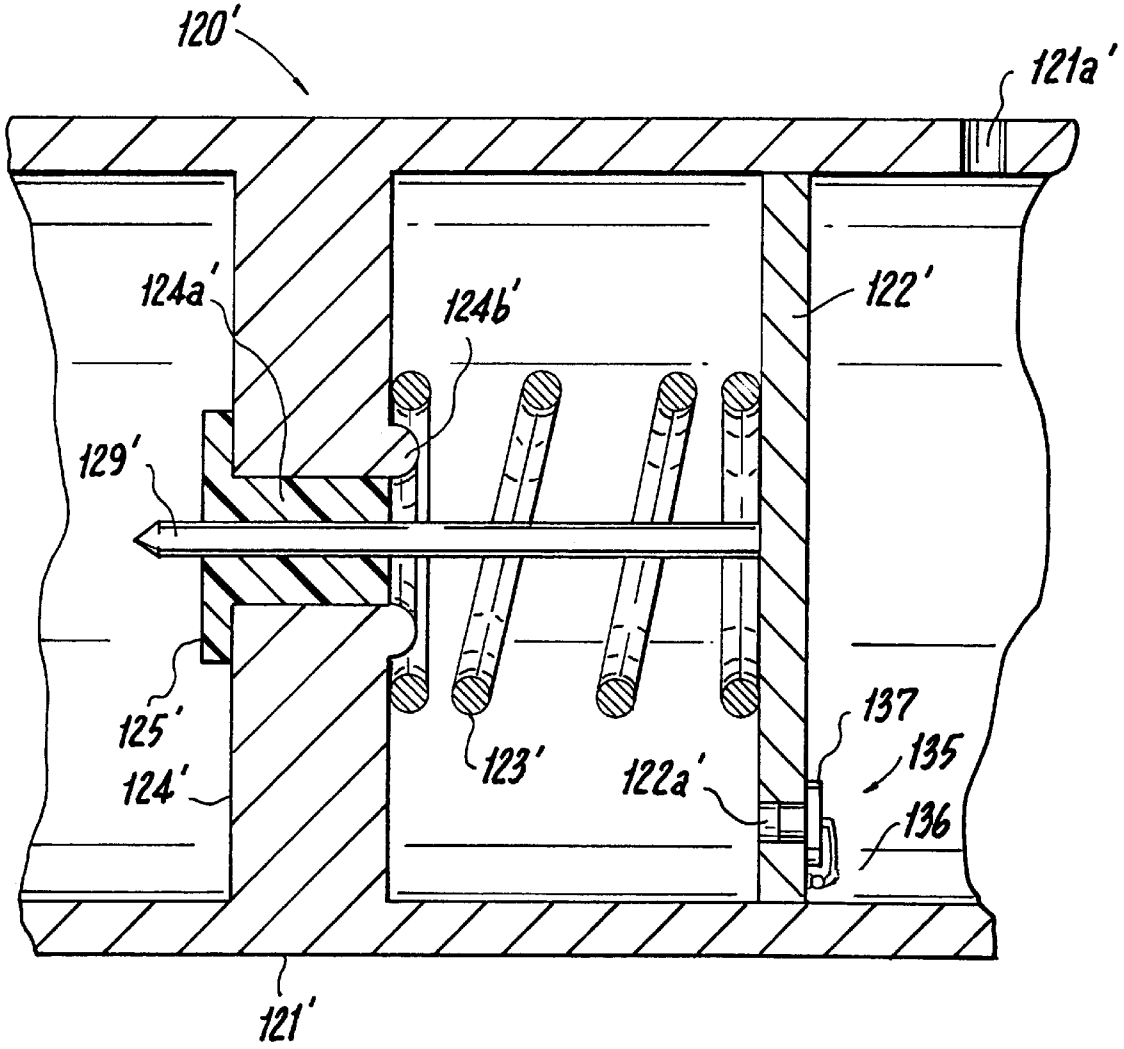
FIG. 2 is a side view of an alternative embodiment of the piston of FIG. 1.

Piston plate 122 is slidably mounted within the first chamber 128*a* and is biased by helical compression spring 123 to a proximal position. Spring 123 is mounted between retainer plate 124 and piston plate 122. Annular ridge 124*b* extends around the periphery of aperture 124*a* in the retainer plate and helps to maintain the position and alignment of spring 123. Piston plate 122 includes a vent aperture 122*a* which has a diameter ranging from about 1/32" to about 1/8", preferably about 1/16". The vent aperture 122*a* permits passage of gas through the piston plate 122 to avoid excessive buildup of pressure between the piston plate 122 and retainer plate 124. Alternatively, as shown in FIG. 2 piston plate 122' can optionally include a check valve 135 to permit passage of gas in only a proximal direction through aperture 122*a*'. Check valve 135 can, for example, be a stopper 137 hingedly mounted at hinge 136 and biased by a spring to a closed position covering the proximal end of aperture 122*a*'. As shown in FIG. 2, firing assembly 120' includes a spring 123' corresponding to spring 123 described above. The retainer plate 124' has an aperture 124*a*' corresponding to aperture 124*a* and an annular ridge 124*b*' corresponding to annular ridge 124*b*. Bushing 125' corresponds to bushing 125 described below. Firing pin 129' corresponds to firing pin 129 discussed below. Upon distal movement of piston plate 122' when the squib is fired and/or buildup of excess gas pressure in the space between piston plate 122' and retainer plate 124', gas flows proximally through aperture 122*a*' and overcomes the biasing force of the check valve spring to enter the first chamber. Thereafter, the excess gas can exit through vent aperture 121*a*'. Various other type check valves known in the art may alternatively be used.

Referring again to FIG. 1, a firing pin 129 projects distally from the piston plate along the axis of firing assembly 120. Bushing 125 is fabricated from a metal or rubber member and is mounted within aperture 124*a* in retainer plate 124. The firing pin 129 extends through an axial aperture in bushing 125. Bushing 125 is configured to sufficiently close tolerances with respect to firing pin 129 and aperture 124*a* to provide a gaseous seal.

A distal mounting plate 126 provides means for mounting the cartridge 110 to the firing assembly 120. Threaded aperture 127 in the mounting plate is adapted to removably engage sealed outlet portion 111 of the cartridge 110. Alternatively, the sealed outlet portion 111 can engage aperture 127 with a bayonet type mounting.

A squib assembly 140 provides propelling means and includes a safety housing 142 attached by a threaded screw type engagement to housing 121. The safety housing 142 encloses an electrically fired explosive squib 141. An opening 143 directs gases from the exploding squib into chamber 128*a*. When the squib 141 is activated piston plate 122 is propelled distally by the explosive gases released into first chamber 128*a*. Firing pin 129 then punctures the sealed outlet portion 111 of the fire agent cylinder 110, thereby releasing fire extinguishing agent and/or propellant into second chamber 128*b*. From there the gases are conveyed via duct 132 to a discharge chamber 130 which is positioned where the fire is to be suppressed, for example, in the engine compartment of the vehicle or in the fuel tank area. The fire extinguishing agent exits the discharge chamber 130 via one or more nozzles 131 to extinguish or suppress the fire.

Control of the fire extinguishing system is provided by a control assembly 200, which includes a housing 201, indicator lights 205 and 206, three-position switch 210, and audible alarm 207. Switch 210 includes a handle 202 slidably disposed in slot 203 and movable into any of three positions. In a first upward position the control system is on automatic status and the system will activate the firing assembly 120 when either of impact sensor 160 or temperature sensor 170 detects a collision or fire, respectively. Optionally, two or more impact sensors 160 or temperature sensors 170 may be used. In a middle second position of switch handle 202 the control system is in an "off" status. The control system will not operate nor will the squib assembly 140 be fired while the control system 200 is in the "off" status. In the third bottom position of switch handle 202 the control system is manually activated and the propelling means 140 is fired. Preferably, slot 203 through which switch handle 202 is disposed includes means to prevent the switch handle from inadvertently being moved to the third position. For example, slot 203 can include detents 204 which project into the slot. The detents 204 can be manually retracted to permit passage of the switch handle to the third position. Alternatively, the detents 204 can be resiliently moved to permit passage of the switch handle only upon application by the user of a predetermined amount of manual force which is greater than that normally sufficient to move the switch. This helps to ensure that movement of the switch into the manual position is intentional.

The control system is powered by a battery B (for example, the vehicle battery) to which the system is electrically connected by line 102. Line 101 carries an electric current to positive terminal 105 of the squib. The negative terminal 106 is connected to ground. The control system is connected to impact sensor 160 by line 103, and to temperature sensor 170 by line 104.

Impact sensor 160 is a switching mechanism which activates in response to a vehicle collision. An impact switch suitable for use in the present invention is available from All Electronics Corp. and Herbach and Rademan Company.

Temperature sensor 170 is a switching mechanism which activates in response to a vehicle fire. A temperature sensor suitable for use in the present invention is available from H&R Electric Co.

Figure 3:
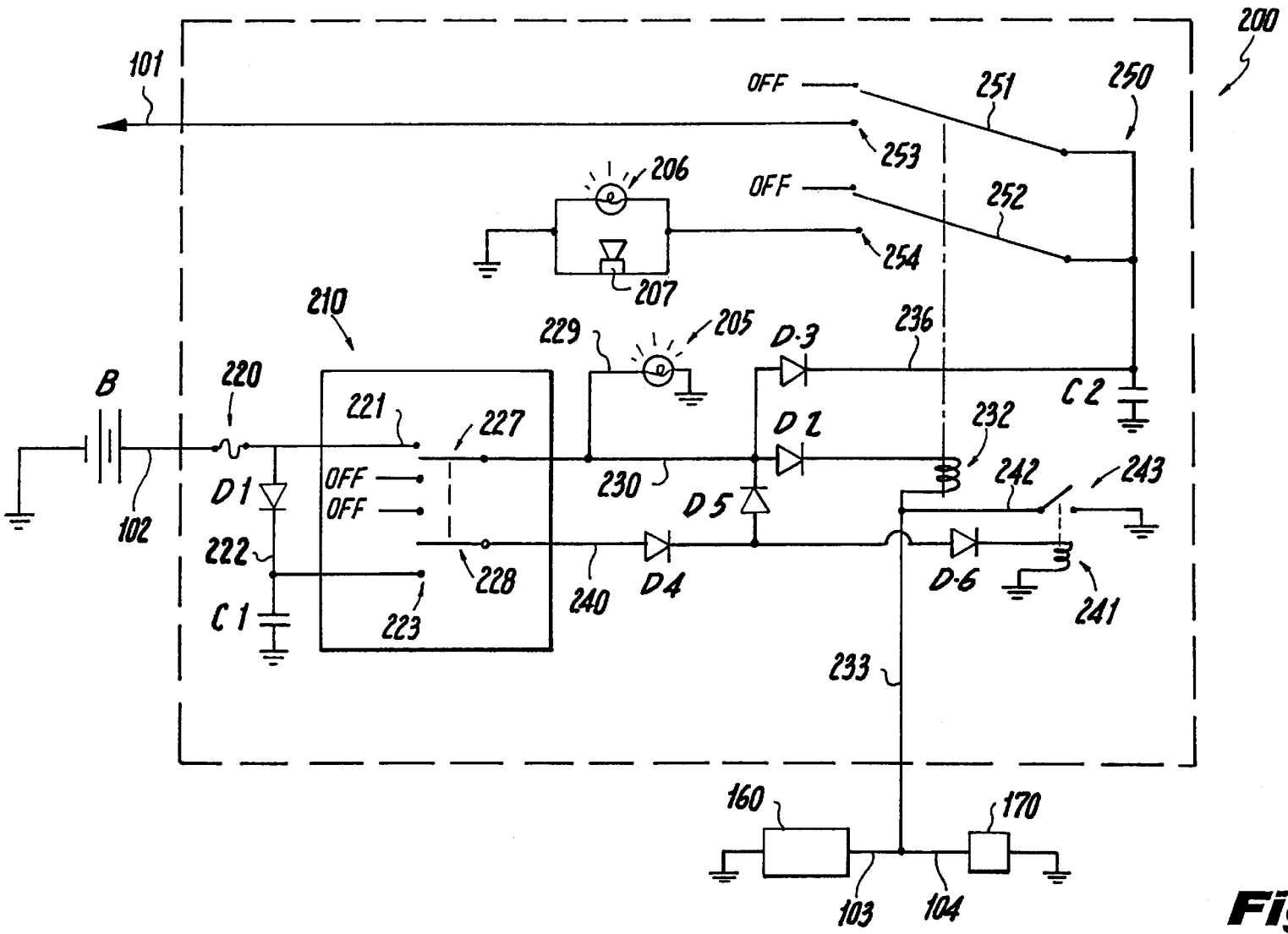
FIG. 3 is a diagram of the electric circuitry of the control system.

Referring now to FIG. 3 the circuitry of control assembly 200 is shown wherein C-1 and C-2 are capacitors which are preferably capable of storing energy of a quarter to a half of a joule at a potential of the level of about 12 to 20 volts and also preferably having very low leakage so that the charge can be stored for a long period of time. Rectifier diodes D-1, D-2, D-3, D-4, D-5, and D-6 are selected so as to accommodate the voltage and current requirements of the system. Battery B is preferably a 12-volt automobile battery.

More specifically, line 102 conveys current from battery B to the control assembly 200. A circuit breaker or fuse 220 protects the circuitry of control assembly 200 from current surges.

Line 222 conveys a current through diode D-1 to capacitor C-1 which remains in a charged state until discharged by movement of switch 210 into a manual firing third position, as discussed below.

Switch 210 is a double-pole three-position switch. In the middle or "off" position poles 227 and 228 are not in contact with any switch terminals. In a first "automatic" position, pole 227 contacts terminal 221 and line 230 becomes electrified. Pole 228 contacts the "off" terminal in the first "automatic" position. Line 229 carries current to indicator light 205 which provides visual confirmation that the system is electrically active and in the automatic setting. Also, in the automatic condition both capacitors C-1 and C-2 are charged. In the event of a collision and/or fire, one or both of impact sensor switch 160 and temperature sensor switch 170 will close, thereby establishing a ground. Current will then flow through line 230, through diode D-2, and through the coil of relay 232. Upon activation of relay 232 the double-pole relay switch 250 closes. Poles 251 and 252 of relay switch 250 are resiliently biased to an initial "off" position. Upon closure of relay switch 250, poles 251 and 252 move to a second "on" position in which pole 251 contacts terminal 253 and pole 252 contacts terminal 254. Current will then flow through diode D-3 and line 236, and will be conveyed to line 101 via pole 251. Line 101 conveys the current to the squib assembly 140, whereupon the system is fired and the fire extinguishing agent is released. Current is also conveyed from terminal 254 to indicator light 206 and audible alarm 207. The audible alarm can be, for example, a buzzer, horn, or bell. Also, upon closure of relay switch 250, capacitor C-2 will discharge through line 236 and into switch 250. This discharge provides a pulse of current which facilitates the firing of the system, for example, in the event that battery B is weak or otherwise unable to provide sufficient current.

In the "manual" third position pole 227 is moved to an "off" terminal. Pole 228 moves into contact with terminal 223. Current then flows through line 240 through diodes D-4 and D-6, and through the coil of relay 241 which then closes relay switch 243, thereby establishing a ground. Current then also flows through diodes D-5 and D-2, and through the coil of relay 232, thereby closing switch 250. As discussed above, current then flows through diode D-3 and line 236. Capacitor C-2 supplements the current flow with a pulse of discharge current to facilitate firing of the system.

Figure 4:
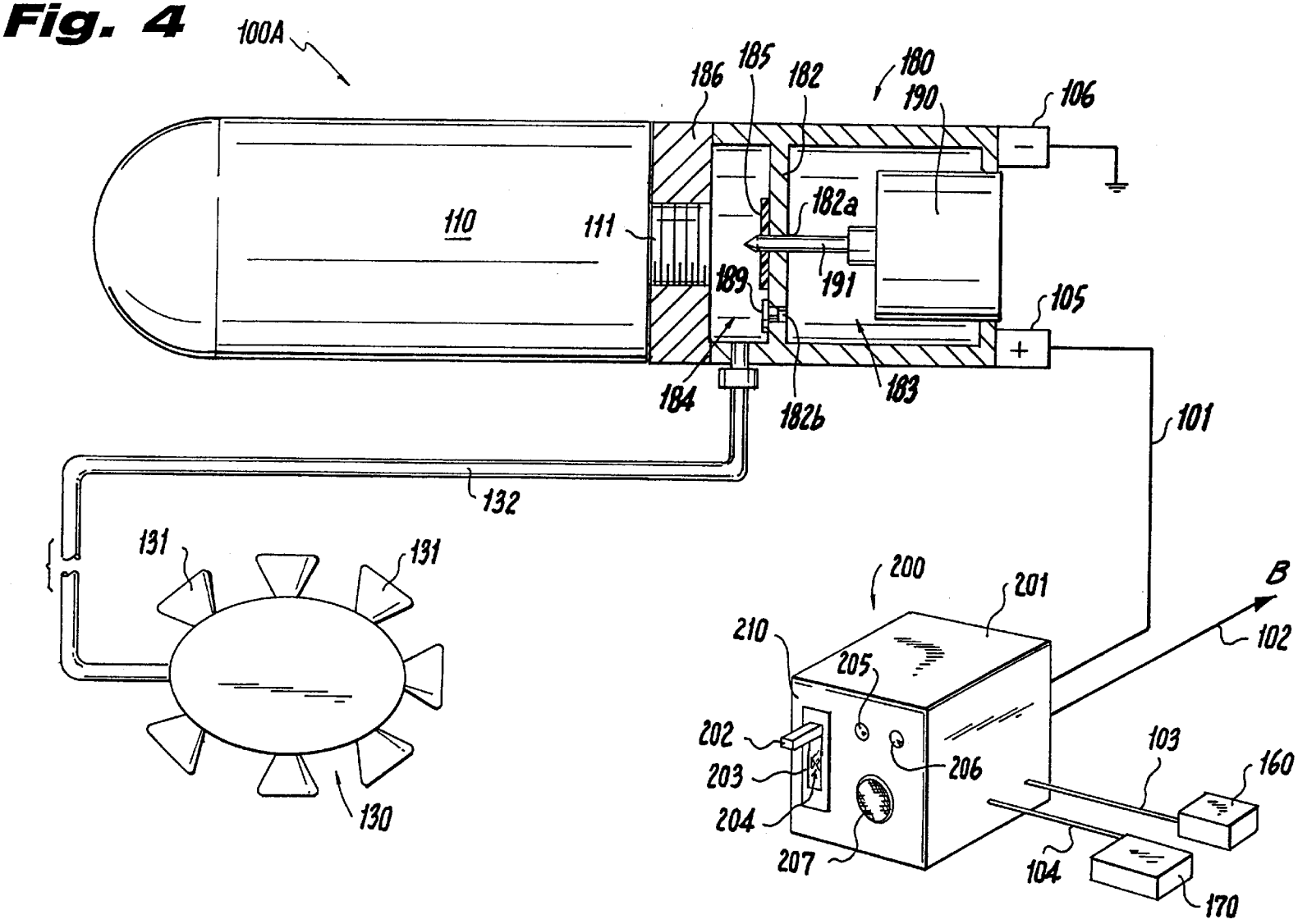
FIG. 4 is an alternative embodiment of the invention employing a solenoid firing system.

Referring now to FIG. 4, an alternative embodiment 100A of the fire extinguishing system is similar to embodiment 100 shown in FIG. 1 except that alternative embodiment 100A employs a solenoid driven firing assembly 180.

More particularly firing assembly 180 includes housing 181 having a retainer plate 182 which divides the housing interior into first and second chambers 183 and 184, respectively. An electrically powered propelling means includes solenoid 190, which is mounted at a proximal end of housing 181 and includes a linearly movable firing pin 191 which extends distally from the solenoid along the axis of the firing assembly 180. Solenoids suitable for use in the present invention are conventional and known to those with skill in the art. The firing pin is slidably disposed through aperture 182*a* in the retainer plate. Firing pin 191 is also disposed through an aperture in sealing material 185. The sheet of sealing material 185, such as rubber, is annularly disposed around aperture 182*a* on the distal side of retainer plate 182 and inhibits the flow of gas through aperture 182*a*. Housing 181 further includes a distal mounting plate 186 having a threaded aperture 187 adapted to receive sealed outlet portion 111 of the cartridge 110. Thus, cartridge 110 can be removably joined with the firing assembly 180 by screw type engagement. Alternatively, a bayonet type mounting engagement may be used.

Retainer plate 182 preferably also includes a second aperture 182*b* having a diameter of from about 1/32 inch to about 1/8 inch, preferably about 1/16 inch. Optionally, a check valve 189 is positioned in conjunction with aperture 182*b* to permit passage of gas distally through aperture 182*b* (i.e., from first chamber 183 to second chamber 184) in the event of a buildup of excess pressure in first chamber 183. The check valve 189 is preferably similar in construction and function to check valve 135 described above.

When the solenoid 190 is activated by electrical current conveyed along line 101, the firing pin 191 is distally advanced with force sufficient to pierce the seal of sealed outlet portion 111. The fire extinguishing agent and/or propellant is released into second chamber 184 and, from there, into discharge duct 132. The fire extinguishing agent is then conveyed to discharge chamber 130 whereupon it exits the system through one or more nozzles 131. Control system 200 controls functioning of the fire extinguishing system, as described above.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A fire extinguishing system for a vehicle comprising:

a) a firing assembly for mounting to a container of pressurized fire extinguishing agent having an outlet with a puncturable seal, the firing assembly including:

a housing having an interior space;

a piston slidably movable within the interior space of the housing between a proximal position and a distal position, the piston having a proximal side and a distal side and a passageway extending between the proximal and distal sides to permit flow of gas therethrough;

a firing pin extending from the distal side of the piston; and firing means responsive to an electric current for advancing the piston from the proximal position to the distal position;

b) a control system controlled by at least one control switch for delivering the electric current to the firing means; and c) means for supplying the control system with the electric current.

2. The fire extinguishing system of claim 1 wherein the passageway is an aperture having a diameter of from about 1/32 inch to about 1/8 inch.

3. The fire extinguishing system of claim 1 wherein the piston further includes valve means to restrict the flow of gas within the passageway of the piston to flow from the distal to the proximal sides.

4. The fire extinguishing system of claim 3 wherein the valve means comprises a check valve.

5. The fire extinguishing system of claim 1 wherein the control system includes at least one capacitor for storing at least a portion of the electric current and delivering said portion of the electric current to the firing means as an electric pulse upon discharge.

6. The fire extinguishing system of claim 5 wherein the at least one control switch of the control system comprises a double-pole switch movable between first, second, and third switch positions.

7. The fire extinguishing system of claim 6 wherein in the first switch position of the control switch the control system delivers the electric pulse to the firing means in response to activation of at least one of an impact sensor and a temperature sensor.

8. The fire extinguishing system of claim 7 wherein the control system delivers the electric pulse to the firing means in response to movement of the at least one control switch to the third switch position.

9. The fire extinguishing system of claim 1 wherein the control system further includes visual and audible means for indicating control system status.

10. The fire extinguishing system of claim 1 wherein the firing means is an electrically ignited explosive squib.

11. The fire extinguishing system of claim 1 wherein the control system includes at least one relay switch.

12. The fire extinguishing system of claim 1 wherein the means for supplying the electric current includes a battery.

13. The fire extinguishing system of claim 1 further including the container of the pressurized fire extinguishing agent.

14. The fire extinguishing system of claim 13 wherein the container of pressurized fire extinguishing agent is releasably mounted to the firing assembly by a threaded attachment.

15. The fire extinguishing system of claim 1 wherein the piston is resiliently biased to the proximal position.

16. The fire extinguishing system of claim 1 wherein the firing assembly further includes a retainer fixedly mounted within the interior space of the housing and having an aperture for reception therethrough of the firing pin.

17. The fire extinguishing system of claim 16 wherein the firing assembly further includes a compression spring mounted between the retainer and the piston.

18. The fire extinguishing system of claim 17 wherein the retainer further includes an annular ridge surrounding the aperture for engaging one end of the spring.

19. A fire extinguishing system for a vehicle comprising:

a) a firing assembly for mounting to a container of pressurized fire extinguishing agent having an outlet with a puncturable seal, the firing assembly including:

a housing having an interior space divided into first and second chambers by a partition having first and second apertures;

a firing pin aligned along an axis of the housing and slidably disposed through the first aperture of the partition, the firing pin being movable between a distal position and a proximal position; and a firing means mounted to the housing, said firing means moving the firing pin from the proximal position to the distal position in response to an electric pulse, wherein the firing means includes a solenoid;

b) a control system controlled by at least one control switch for delivering the electric pulse to the firing means solenoid, wherein said control system includes at least one capacitor; and c) means for supplying the control system with an electric current.

20. The fire extinguishing system of claim 19 wherein the at least one control switch of the control system comprises a double-pole switch movable between first, second, and third switch positions.

21. The fire extinguishing system of claim 20 wherein in the first switch position of the control switch the control system delivers the electric pulse to the firing means in response to activation of at least one of an impact sensor and a temperature sensor.

22. The fire extinguishing system of claim 21 wherein the control system delivers the electric pulse to the firing means in response to movement of the at least one control switch to the third switch position.

23. The fire extinguishing system of claim 19 wherein the control system further includes at least one relay switch.

24. The fire extinguishing system of claim 19 wherein the firing assembly further includes a check valve positioned in conjunction with the second aperture of the partition.

25. A fire extinguishing system for a vehicle comprising:

a) a firing assembly for mounting to a pressurized container of fire extinguishing agent having an outlet with a puncturable seal, the firing assembly including:

a housing having an interior space divided into at least two chambers by at least one partition, the partition having at least one aperture with a check valve positioned in conjunction with the aperture;

a firing pin disposed within the interior space of the housing and movable between a distal position wherein the firing pin punctures the puncturable seal of the pressurized container and a proximal position; and firing means responsive to an electric current for advancing the firing pin from the proximal position to the distal position;

b) a control system controlled by at least one control switch for delivering the electric current to the firing means; and c) means for supplying the electric current to the control system.

26. The fire extinguishing system of claim 25 wherein the partition is movable with respect to the housing and wherein the firing pin is attached to the partition and extends distally therefrom.

27. The fire extinguishing system of claim 26 wherein the firing means includes an explosive squib.

28. The fire extinguishing system of claim 25 wherein the partition is stationary with respect to the housing and the partition has an axial second aperture through which the firing pin is slidably disposed.

29. The fire extinguishing system of claim 28 wherein the firing means includes a solenoid.

* * * * *